US005136923A

United States Patent [19]

Walsh, Jr.

[11] Patent Number: 5,136,923

[45] Date of Patent: Aug. 11, 1992

[54] FIREARM SILENCER AND FLASH ATTENUATOR

[76] Inventor: Donald J. Walsh, Jr., 1941 S. Arlington Ridge Rd., Arlington, Va. 22202

[21] Appl. No.: 728,056

[22] Filed: Jul. 8, 1991

Related U.S. Application Data

[63] Continuation of Ser. No. 384,848, Jul. 17, 1989, abandoned, which is a continuation of Ser. No. 403,445, Jul. 30, 1982, abandoned.

[51] Int. Cl.[5] ..... F41A 21/00

[52] U.S. Cl. ..... 89/14.2; 89/14.4

[58] Field of Search ..... 89/14.2, 14.4

[56] References Cited

U.S. PATENT DOCUMENTS

| | | | |
|---|---|---|---|
| 984,890 | 2/1911 | Dudderar . | |
| 1,127,250 | 2/1915 | Humm . | |
| 2,043,731 | 6/1936 | Bourne . | |
| 2,112,660 | 3/1938 | Hudson . | |
| 2,150,161 | 3/1939 | Green . | |
| 2,271,892 | 2/1942 | Bourne . | |
| 2,351,037 | 6/1944 | Green . | |
| 2,359,365 | 10/1944 | Katcher . | |
| 2,448,382 | 8/1948 | Mason | 89/14 D |
| 2,448,593 | 9/1948 | Heising | 89/14 B |
| 2,448,593 | 9/1948 | Heising | 89/14 B |
| 2,451,514 | 10/1948 | Sieg . | |
| 2,503,491 | 4/1950 | Janz . | |
| 2,515,180 | 7/1950 | Barker | 89/1.7 |
| 2,583,366 | 1/1952 | Engels . | |
| 2,780,962 | 2/1957 | Reasler et al. | 89/14 |
| 2,798,569 | 7/1957 | Fischer, Jr. . | |
| 2,883,781 | 4/1959 | Harvey | 42/1 |
| 3,149,532 | 9/1964 | Pittaway et al. . | |
| 3,399,597 | 9/1968 | Perrine . | |
| 3,858,481 | 1/1975 | Elliott | 89/14 |
| 4,024,790 | 5/1977 | Heiderer | 89/14 B X |

FOREIGN PATENT DOCUMENTS

| | | | |
|---|---|---|---|
| 220470 | 4/1910 | Fed. Rep. of Germany . | |
| 2448865 | 4/1976 | Fed. Rep. of Germany | 89/14 D |
| 401168 | 8/1909 | France . | |

OTHER PUBLICATIONS

"Silencers", Report R-1896 (Dept. of Army) Frankford Arsenal, (Aug. 1968), pp. 19-29, 104-109.

"Schall Dampeer" Waffen Journal, pp. 468-471.

"Acoustic Study Program-Phase III," Final Report, American Machine and Foundry Company, Paladin Press, pp.-22-24, 54-55, 189-192.

"The Silent War," U.S. Military Report, Defense & Foreign Affairs, (May, 1982), pp. 24-25 & 29.

Truby, J. David, "Hear No Evil", Solider of Fortune, (Aug. 1982), pp. 60-63.

*Primary Examiner*—John S. Maples

*Attorney, Agent, or Firm*—Pollock, Vande Sande & Priddy

[57] ABSTRACT

A firearm sound suppressor which includes an outer housing, an interior perforated tube located within the outer housing, and spacing between the outer housing and interior perforated tube, and method of making. The sound suppressor is adapted to be mounted on a firearm.

11 Claims, 2 Drawing Sheets

FIREARM SILENCER AND FLASH ATTENUATOR

This application is a continuation of Ser. No. 07/384,848 filed on Jul. 17, 1989, now abandoned which is a continuation of Ser. No. 06/403,445, filed Jul. 30, 1982, now abandoned.

TECHNICAL FIELD

The present invention is concerned wit sound suppressors and flash attenuators for firearms Devices according to the present invention are suitable for both single barrelled weapons and for multibarrelled revolving cannons. The present invention is also directed to a method for making a silencer

BACKGROUND ART

One general type of sound suppressor or silencer now available includes an assembly of spaced baffles located in an outer casing or housing. These baffles may be perpendicular to the bore, conical (usually rearward-slanting), or helical. The spacing between the baffles provides discrete expansion chambers.

A somewhat different, but structurally similar approach includes packing the outer casing with washer-like members cut from, for example, woven wire screen mesh or compressed knitted wire mesh.

The above types of silencers have a central bore for passage of the projectile. This bore is larger than the projectile to preclude contact between the silencer and the projectile which could result in loss of accuracy and damage to the silencer.

Extensive research has been conducted over the years with baffle-type silencers, the better examples of which perform well accoustically However, baffle-type silencers are difficult and expensive to manufacture, which has significantly limited their utilization. This difficulty is due to the conflicting requirement of minimum clearance for the projectile to yield maximum attenuation, and the multiplicative tolerances of the components which must be maintained to ensure alignment along these lines (see pages 23 and 54 of AMF Final Report Phase III, Paladin Press). These types of suppressors suffer from the disadvantage of being relatively heavy. Such suppressors are unlikely to be interchangeable between guns of the same model and can be easily misaligned by rough handling in the field. For the most part, these suppressors have to be custom made and fitted for any particular weapon.

The wire screen washer packed silencer performs well, both accoustically and as a muzzle flash reducer, when initially installed. The good performance is believed to be due to the rapid heat exchange between the propellant gases and the large surface area of conductive metal. Such silencers are generally more efficient on a volume basis and for a given projectile clearance than baffle silencers. Accordingly, those types of silencers can be smaller than baffle silencers while achieving similar performance.

However, gradual fraying of the cut woven mesh packing requires periodic maintenance. In addition, such can be easily misaligned by rough handling in the field. A few isolated suggestions have appeared in the literature that a thin walled central tube can be used to support packing material. Specifically, it has been suggested to wrap the thin walled tube with packing such as screen, steel wool, fiberglass, metal shavings, and turnings.

DISCLOSURE OF THE INVENTION

The sound suppressors of the present invention are useful for attenuation of flash and blast for a wide assortment of small arms. Moreover, the sound suppressors of the present invention are useful for recoil attenuation for various small arms. The silencers of the present perform better as compared to prior art silencers for a given silencer volume. Accordingly, a relatively greater amount of clearance for the bullet can be employed for a given silencer volume and/or desired level of performance for the silencers of the present invention.

One aspect of the present invention is concerned with a silencer adapted to be mounted on a firearm. The silencer includes an outer housing and an interior tube within said housing. The interior tube is spaced from the inside walls of the housing. The interior tube extends at least substantially the entire length of the housing which is adapted to be forward of the muzzle of a firearm to which the silencer is to be attached. In addition, the interior tube is adapted to receive a projectile discharged from the firing chamber of the firearm. The interior tube is perforated with a plurality of rows of ports. The minimum diameter of the ports in the inner tube is at least about 50% of the inside diameter of the inner tube. The minimum thickness of the wall of the interior tube, at least where perforated, is the lesser of either at least about 50% the inside diameter of the interior tube or at least about ⅛ inches.

In, a preferred aspect of the present invention, the spacing between the outer housing and inner tube is at least substantially (e.g., less than about 2% of the volume occupied), if not entirely, free from packing material.

In another aspect of the present invention, packing is located in the space between the outer housing and interior tube.

Additional aspects of the present invention include dividing the space between the outer housing and inner tube into multiple radially extending chambers, such as by providing at least one radially extending wall or partition in both of the above types of silencers of the present invention.

Another aspect of the present invention is a sound suppressed firearm having a barrel with an axis and an inner diameter; and a silencer. The silencer has a thin walled outer tubular shell or housing and an interior tube with walls thicker than the walls of said shell. The interior tube has radial ports. As used herein, "radial" means simply transverse to the axis of the interior tube, but not necessarily normal to that axis. Also, the silencer has means between the outer shell and interior tube for defining a volume therebetween. In addition, means are provided for directly attaching the interior tube to the muzzle of the weapon, whereby the axis of the barrel is at least substantially aligned with the axis of the interior tube.

If desired, the volume between the outer and interior tube can include baffle material and/or at least one radially extending partition.

A still further aspect of the present invention is a method of making a silencer. The method includes a) providing a relatively thick walled interior tube having radial performations;

b) wrapping knitted metallic fabric around the outside diameter of said interior tube; and c) enclosing the wrapped interior tube within a thin walled outer shell or housing having walls thinner than the walls of said interior tube.

BEST AND VARIOUS MODES FOR CARRYING OUT THE INVENTION

Figure 1:
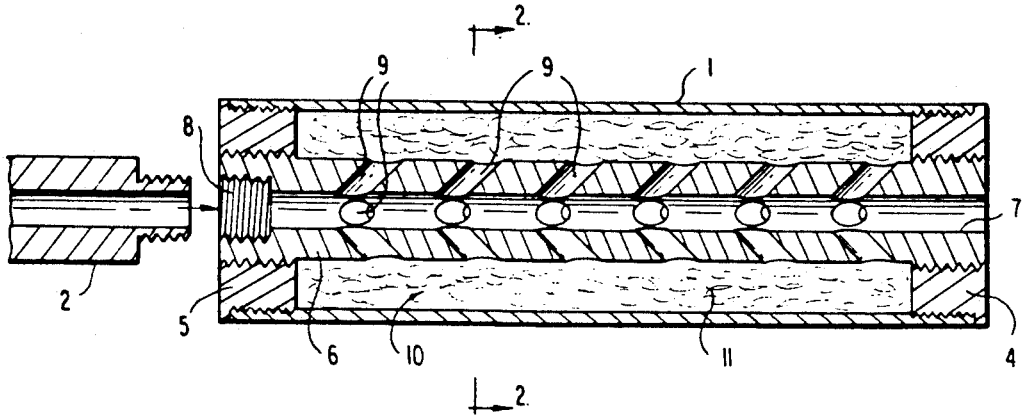
FIG. 1 shows an axial cross-section of a silencer embodying the present invention.
Figure 2:
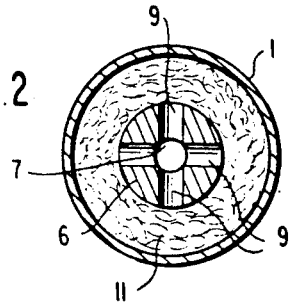
FIG. 2 shows a view taken on line 2—2 of FIG. 1.

With reference to FIGS. 1 and 2, the silencer is seen to comprise an outer housing or tubular outer shell 1, which preferably is a relatively thin walled high temperature resistance tube of at least about 0.040 inch wall thickness and preferably about 1/16 to about ⅛ inches. For single barrel small arms, the outside diameter of housing 1 is generally about 1¼ inches to about 4 inches. Typically materials which are suitable for housing 1 include aluminum, steel such as chrome-moly steel and plastics. The outer shell is preferably imperforate and has enough strength for resisting blast pressures. In general, for most small arms, the length of housing 1 is about 5 inches to about 25 inches and preferably about 8 inches to about 15 inches. As used herein, "small arms" means weapons having bore diameters in the range of 0.17" to 40 mm.

Figure 3:
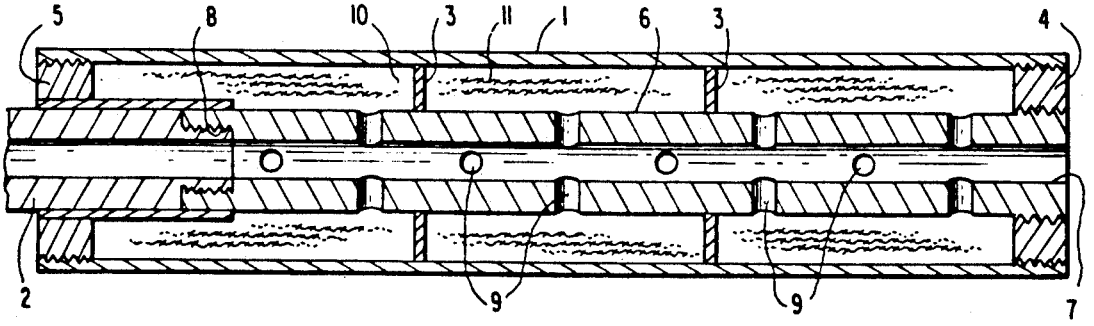
FIG. 3 shows an axial cross-section of another silencer within the scope of the present invention.
Figure 4:
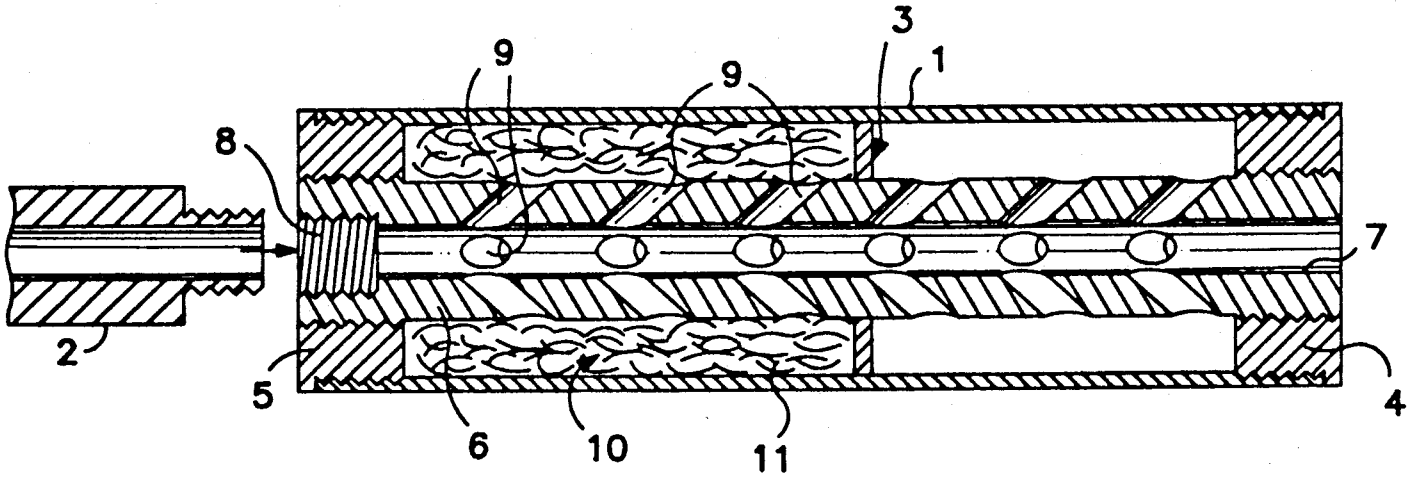

As shown-in FIG. 3, housing 1 also can extend or telescope back over the barrel 2 of the firearm when the silencer is attached. This is of particular advantage when the volume between the outer shell and inner tube is partitioned into two or more sections, by radially extending walls 3, as illustrated in FIG. 3. Walls 3 preferably are imperforate. Housing 1 can be concentric with or radially offset below the top of the barrel so as not to interfere with the line of sight of the firearm.

End caps 4 and 5 space housing 1 from an interior tube 6 and have sufficient strength to resist blast pressure. End caps 4 and 5 are preferably attached by threaded joints, as illustrated. Interior tube 6 has a bore 7 with a length and diameter adequate to pass a projectile from the muzzle of a barrel 2. The diameter of bore 7 is at least as large as that of the bore of barrel 2 and generally is somewhat larger to provide a clearance for the bullet or projectile. Bore 7 is large enough so that when interior tube 6 is screwed onto a muzzle of a firearm having the maximum anticipated misalignment of the axis of its end threads 8 from the axis of barrel 2, a bullet can still pass through interior tube 6 without contact. For small arms, the inner tube generally has a total clearance of about 0.01 inch to about 0.05 inch for the bullet to pass. The total clearance for the silencer of the present invention can be larger for a given silencer volume and/or desired level of performance than the total clearance for prior art silencers.

The inside diameter of the end of interior tube 6 is threaded at 8 to mate directly with threads on a gun barrel. Preferably, tube 6 is made from seamless aluminum or steel having an axial straightness of about 0.005"/ft.

End caps 4 and 5 and housing 1 are not involved in alignment of the suppressor of the present invention but as stated above are for containment of the muzzle blast. Accordingly, the outer housing 1 may be made eccentric to the bore, which may be required to clear the line of sight of a weapon, and which would be difficult to do with other silencers. Likewise, the outer housing may be rectangular or square or any other geometry required for novel applications without affecting the alignment of the silencer or the ease of manufacture.

A special case is the sound suppressor for multibarrel guns such as revolving cannons as per the 20 mm Vulcan and 25 mm GE GAU-12/U Equalizer. Such weapons fire powerful ammunition at high rates and conventional baffle suppressors would be complex and expensive to build for them. However, an inner core tube affixed to each barrel, properly aligned with the bore and attached either to the muzzle or to the muzzle clamp, encased with the other inner tubes in a common housing, is a simple, effective solution. Back blast through the open bolts of the non-firing barrels from the common housing can be prevented by the use of a star-shaped divider to give individually packed discrete expansion chambers. The front cap can be held on by castle nuts threaded onto the central tubes.

Such an assembly presents no problems even when such multibarrel revolving weapons are arranged with the muzzle clamp in such a manner as to deliver a slightly fan shaped cone of fire, or the barrels converge slightly toward a central axis so that the cone of fire converges at a set distance downrange (as is common on the Anti-aircraft weapons of this type).

Sound suppressors of this type are useful for helicopter gunships equipped with such revolving cannon, to reduce flash and noise, improve night vision and radio communcations, and on jet aircraft employing such weapons in fixed pods, where the muzzle blast can be sucked into the jet intakes and cause flameout.

Accordingly, the present invention is intended to encompass providing one or a plurality of inner tubes of the type defined herein within the outer shell 1.

Inner tube 6 is perforated; that is, it includes a number of groups of radially extending ports 9. The ports or holes 9 can be any desired shape, and are preferably substantially circular for ease of manufacture. The ports 9 are preferably angled at about 30° to about 60° and most preferably about 30° to about 45° to the axis of inner tube 6, back towards the muzzle of the firearms to which the silencer is to attached. However, the ports 9 can be set over a wide range of angles including perpendicular to the tube axis and leading towards the outlet end of the silencer. This latter arrangement may be advantageous in a silencer for a shotgun to prevent pellets from being trapped. Generally, inner tube 6, includes at least three groups of radially extending ports 9 and preferably at least about four to six groups and typically up to about 12 to about 20 groups of four ports each. The size of the ports is such that the diameter along any central axis of a port is at least about 50% of the inside diameter of interior tube 6, preferably at least about 75% of the inside diameter of tube 6. Most- preferably the diameter of ports in tube 6 is about 1 to about 1.5 times the inside diameter of tube 6. Generally, the maximum diameter of ports is about 2× the inside diameter of tube 6.

The minimum thickness of material between adjacent ports 9 must be sufficient to permit the tube to maintain its structural mechanical stability. In general, no portion of a port will overlap or underlap an adjacent coaxial port. Also usually, the spacing of axially-aligned holes from the center of one to the center of the next adjacent hole is at least about 1.1 times the diameter of the holes, and preferably is about 1.6 times the diameter of the holes. The configuration of the rows of the ports 9 can vary greatly. One example includes a port through the top, a corresponding port through the bottom of the tube, and two ports about 90° offset from the ports through the top and bottom, each extending through one side of the tube 3.

Such a configuration is illustrated in FIG. 2. Another example includes a port through the top and a port through the bottom of the tube, and axially spaced therefrom two ports rotated about 90°, each extending through one side of the tube as illustrated in FIG. 3. Ports 9 can also be arranged along spiral paths around interior tube 6, so long as adequate strength is maintained.

Ports 9 divert the muzzle blast gases outward toward the volume between inner tube 6 and outer housing 1. The ports make it possible for the silencer to include a relatively large radial clearance within the inner tube to accommodate misalignment and still be an effective silencer.

The inner tube is constructed so that in the unlikely event a bullet strikes its interior, the tube will have sufficient strength to deflect it and prevent it from exiting through the side of the silencer. In particular, the inner tube is made of a high strength material such as seamless drawn or extruded aircraft tubing of for instance steel or aluminum with a relatively thick wall. The wall is generally thicker than the wall of the outer housing. The minimum thickness at least where perforated is generally at least about ⅛ inch and is usually at least about 25% of the inside diameter of tube 6. Preferably the minimum thickness of the wall is the lesser of about 50% the inside diameter of the inner tube 6 or at least about 3/16 inch.

Generally, the maximum thickness of the wall of tube 6 is approximately equal to the inside diameter of tube 6 preferably about 75% of the inside diameter of tube 6 and most preferably about 65% of the inside diameter of tube 6.

The radial spacing 10 between the inner tube or each tube or chamber of a multibarrel silencer and outer housing is such that the ratio of the total free volume between tube 6 and housing 1, including the volume of bores 9, to the volume of the bore of barrel 2 is in the range of about 10:1 to about 40:1 and preferably about 20:1 to about 30:1. The silencers of the present invention provide a larger free volume as compared to baffle-type suppressors of the equivalent size and weight.

The following tabulation illustrates some preferred dimensions of the inner tube 6 of silencers of the present invention for various weapons:

| Weapon | Outside Diameter of Inner Tube Inches | Inside Diameter of Inner Tube Inches | Port Size Inches |
|---|---|---|---|
| .223" Caliber (5.56 mm U.S. M16A1) | ⅞ | ¼ | ¼-⅜ |
| .308"/7.62 mm NATO | ⅞ | ¼ | ¼-⅜ |
| .380"/9 m/m Para | ⅞-1 | ⅜ | ¼-⅜ |
| .45 ACP | 1 | ½ | ⅜-½ |
| .50 Browning MG | 1-1½ | ½ | ½ |
| 25 m/m | 1¾-2½ | 1 3/32 | ½-1 |
| 30 m/m | 2-3 | 1 7/16 | ¾-1½ |

If desired, packing material or baffle material 11 can be included between tube 6 and housing 1. This packing material can include screen, steel wool, fiberglass, metal bearings, and preferably knitted metallic fabric of the Metex Corporation type known for use in silencers not having an inner tube. The packing is preferably of a conductive alloy with good corrosion resistance such as phosphor bronze or beryllium copper. Preferably, the packing 11 or baffle screening is wrapped around inner tube 2 with an initial metal to air density of about 5-15%. In use, the knitted metal is compressed by the blast pressure usually to a density of about 30 to 40%. Surprisingly, however, the compression does not result in a permanent degradation of performance. Those embodiments which include packing demonstrate the best performance with respect to flash attenuation and in fact usually result in complete flash reduction.

FIG. 3 shows an embodiment wherein radial partitions 3 are provided between the inner tube 6 and housing 1 to form a plurality of chambers (packed and/or unpacked). Generally, 4 partitions are used. Preferably one partition about midway is employed. The partitions can be threaded onto interior tube 6 or welded to both interior tube 6 and outer housing 1. The partitions may be solid or perforated to control gas flow from chamber to chamber. The purpose is to keep some mesh closer to the muzzle so that the quenching of the muzzle blast flame-front at a point of greatest efficiency is unimpaired. This prevents secondary ignition and muzzle flash. In the most preferred embodiment of the present invention, the space is divided into two approximately equal chambers with the packing in only the near chamber closest the muzzle of the weapon.

The following decibel data was recorded from the silener arrangements discussed below for a MI6AI weapon. All of the silencers are about 8" long. The packing when used is the preferred knitted metallic fabric wrapped around the inner tube to about 5-8% density of metal to air. The inner tubes had an outside diameter of about ¾" and inside diameter of about ¼". The outside diameter of the housing was about 1¾". The holes are equally spaced and are in the configuration shown in FIG. 3.

| Number of Chambers | Packing | Angle of Ports | No. of Ports | Size of Ports | dB | Change in dB |
|---|---|---|---|---|---|---|
| 1 | No | 30 | 60 | ¼" | 140 | −25 |
| 1 | No | 45 | 60 | ¼" | 140 | −25 |
| 1 | No | 30 | 40 | ⅜" | 140 | −25 |
| 1 | No | 45 | 40 | ⅜" | 140 | −25 |
| 1 | Yes | 45 | 60 | ¼" | 136-137 | −28/−29 |
| 2 (Partition at midpoint) | No | 30 | 60 | ¼" | 131 | −34 |
| 2 (Partition at midpoint) | No | 30 | 40 | ⅜" | 130 | −35 |
| 2 (Partition at midpoint) | Yes | 30 | 60 | ¼" | 136 | −29 |
| 2 (Partition at midpoint) | Yes Front only (away from muzzle) | 30 | 60 | ¼" | 135 | −30 |
| 2 (Partition at midpoint) | Yes Rear - Only (chamber | 30 | 60 | ¼" | 129-130 | −35/−36 |

-continued

| Number of Chambers | Packing | Angle of Ports | No. of Ports | Size of Ports | dB | Change in dB |
|---|---|---|---|---|---|---|
| | closest to muzzle) | | | | | |
| 2 (Partition at midpoint) | Yes Rear Only (chamber closest to muzzle) | 30 | 40 | ⅛" | 128 | −37 |
| 2 (Partition at midpoint with chamber extending over muzzle as seen in FIG. 3) | Yes Rear Only | 30 | 40 | ⅛" | 127 | −38 |
| 3 (Partition at midpoint and at middle of rear half) | No | 30 | 60 | ¼" | 130 | −35 |

The above results indicate that the unpacked single chamber version is about 5 to 7 dB better than that of the Sionics, Hel M4 or FA-XM M16 suppressors or several current commercial suppressors for the same caliber, and of the same or larger size and/or weight. The partitioning of the chamber into two chambers cut the noise in half (e.g., −10 dB effectively means half the loudness). The presence of packing in the front chamber of a two chamber silencer has a deleterious effect on noise reduction.

What is claimed is:

1. A sound suppressor for mounting on a firearm wherein the suppressor consists essentially of:

a) an outer housing;

b) an interior hollow tube located within said outer housing at least substantially the length of the housing which is to be located forward of the muzzle of a firearm to which the suppressor is to be attached, wherein said tube is for receiving a projectile discharged from the firing chamber of said firearm, said tube being perforated with a plurality of ports, the minimum diameter of ports being at least about 50% of the inside diameter of said interior tube, and the minimum thickness of the wall of said tube being at least about ⅛ inch, and wherein said interior hollow tube has a bore larger than the bore of the muzzle of a firearm to which the suppressor is to be attached to thereby provide clearance for said projectile;

c) spacing between said housing and said tube; and d) packing material located within said spacing; and wherein said spacing is divided into two chambers by a radially extending partition located about midpoint of the length of the suppressor which is to be forward of the muzzle of the firearm and wherein packing is present in only the chamber closest to the muzzle of the firearm to which the suppressor is to be attached.

2. The suppressor of claim 1 wherein said minimum diameter is at least about 75% of the inside diameter of said interior tube.

3. The suppressor of claim 1 wherein said minimum diameter is about 1 to about 1.5 times the inside diameter of said interior tube.

4. The suppressor of claim 1 wherein said ports are angled at about 30° to about 60° back towards the muzzle of the firearm to which the suppressor is to be attached.

5. The suppressor of claim 1 wherein said minimum diameter is at least about 75% of the inside diameter of said interior tube; said ports are angled at about 30° to about 60° back towards the muzzle of the firearm to which the suppressor is to be attached; said interior tube includes means for directly attaching said interior tube to said barrel, and wherein said interior tube has a bore larger than the bore of the muzzle of a firearm to which the suppressor is to be attached to thereby provide clearance for said projectile.

6. The suppressor of claim 1 wherein the minimum thickness of the wall of said interior tube being at about 3/16 inch.

7. The firearm of claim 9 wherein said interior tube contains threads to mate directly with threads on said barrel.

8. The suppressor of claim 1 wherein said minimum diameter is about 1 to about 1.5 times the inside diameter of said interior tube.

9. A sound suppressor and firearm combination wherein the firearm has a barrel with an axis and an inner diameter and wherein said suppressor consists essentially of a thin walled outer housing and an interior tube with walls which are thicker than the walls of said housing, wherein said inner tube has radial perforations, wherein said interior tube has a bore larger than the bore of the muzzle of said firearm to which the suppressor is attached to thereby provide clearance for a projectile from said barrel, said suppressor also including means between the outer wall and interior tube to define a volume therebetween; and means for directly attaching said interior tube to the barrel of said firearm and whereby the axis of the barrel is sufficiently aligned with the axis of said interior tube so that said interior tube is capable of receiving a projectile from said barrel and wherein said volume is divided into two chambers by a radially extending partition located about midpoint of the length of the suppressor located forward of the muzzle of the firearm and wherein packing is present in only the chamber closest to the muzzle of the firearm to which the silencer is attached.

10. A method of fabricating a sound suppressor for mounting on a firearm which comprises:

a) providing a relatively thick walled interior tube having radial perforations and having a bore larger than the bore of the muzzle of a firearm to which the sound suppressor is to be attached to thereby provided clearance for projectile from the barrel of said firearm;

b) wrapping knitted metallic fabric around the outside diameter of said interior tube; and c) enclosing the wrapped interior tube within a thin walled outer shell having walls thinner than the walls of said interior tube;

d) dividing the space between the said interior tube and said outer shell divided into two chambers by a radially extending partition located about midpoint of the length of the suppressor which is to be forward of the muzzle of the firearm and providing said fabric in only the chamber closest to the muzzle of the firearm to which the silencer is to be attached.

11. The method of claim 10 wherein the wrapping provides a metallic to air density of about 5–15%.

* * * * *